US008306471B2

(12) United States Patent
Matsuduki

(10) Patent No.: US 8,306,471 B2
(45) Date of Patent: Nov. 6, 2012

(54) IMAGE-FORMING DEVICE WITH A RETREAT UNIT AND IMAGE-FORMING METHOD EMPLOYING A RETREAT UNIT

(75) Inventor: Masato Matsuduki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 700 days.

(21) Appl. No.: 12/369,321

(22) Filed: Feb. 11, 2009

(65) Prior Publication Data

US 2009/0208267 A1 Aug. 20, 2009

(30) Foreign Application Priority Data

Feb. 14, 2008 (JP) ..... 2008-033332

(51) Int. Cl.
*G03G 15/00* (2006.01)
*G03G 15/20* (2006.01)

(52) U.S. Cl. ..... 399/384; 399/337

(58) Field of Classification Search ..... 399/323, 399/332, 336, 337, 384
See application file for complete search history.

(56) References Cited

U.S. PATENT DOCUMENTS 5,315,359 A * 5/1994 Nishikawa ..... 399/323
5,475,481 A * 12/1995 Nishikawa et al. ..... 399/297
5,956,554 A * 9/1999 Yanashima et al. ..... 399/328
6,526,239 B2 * 2/2003 Shiiya ..... 399/67
2006/0062618 A1 * 3/2006 Kobayashi et al. ..... 399/384

FOREIGN PATENT DOCUMENTS

| | | |
|---|---|---|
| JP | 09-080960 | 3/1997 |
| JP | 2000-181280 | 6/2000 |
| JP | 2002-062755 | 2/2002 |
| JP | 2006-091159 | 4/2006 |
| JP | 2007-148028 | 6/2007 |

* cited by examiner

*Primary Examiner* — Judy Nguyen
*Assistant Examiner* — Justin Olamit
(74) *Attorney, Agent, or Firm* — Morgan, Lewis & Bockius LLP

(57) ABSTRACT

An image-forming device includes: a tension applying unit that applies tension to a recording medium; an image carrier that holds a toner image; a transfer unit that transfers the toner image held by the image carrier to the recording medium while tension is applied to the recording medium; a fixing unit that fixes the toner image transferred to the recording medium; and a retreat unit that causes the recording medium to move away from the fixing unit while tension is not applied to the recording medium, wherein rotation of the image carrier is suspended after the toner image is transferred from the image carrier to the recording medium, and after the suspension of rotation of the image carrier, application of tension to the recording medium is suspended, and the recording medium is caused to move away from the fixing unit by the retreat unit.

5 Claims, 9 Drawing Sheets

IMAGE-FORMING DEVICE WITH A RETREAT UNIT AND IMAGE-FORMING METHOD EMPLOYING A RETREAT UNIT

CROSS-REFERENCE TO RELATED APPLICATIONS

This application is based on and claims priority under 35 USC 119 from Japanese Patent Application No. 2008-033332 filed on Feb. 14, 2008.

BACKGROUND

1. Technical Field

The present invention relates to an image-forming device and an image-forming method.

2. Related Art

Methods have been proposed in connection with an image-forming device in which continuous form paper (a sheet extending in a longitudinal direction) is used for preventing damage to a sheet from heat generated by a fixing unit of the device.

SUMMARY

An aspect of the present invention provides an image-forming device including a transport unit that transports a recording medium that extends in a longitudinal direction; a tension applying unit that applies tension to the recording medium; an image carrier that holds a toner image; a transfer unit that holds the recording medium between the transfer unit and the image carrier and that transfers the toner image held by the image carrier to the recording medium while tension is applied to the recording medium by the tension applying unit; a fixing unit provided downstream in a transport direction of the recording medium relative to the image carrier, that fixes the toner image transferred to the recording medium on the recording medium; and a retreat unit that causes the recording medium to move away from the fixing unit while tension is not applied to the recording medium by the tension applying unit, wherein rotation of the image carrier is suspended after the toner image is transferred from the image carrier to the recording medium, and after the suspension of rotation of the image carrier, application of tension to the recording medium by the tension applying unit is suspended, and the recording medium is caused to move away from the fixing unit by the retreat unit.

BRIEF DESCRIPTION OF THE DRAWINGS

Exemplary embodiments of the present invention will now be described in detail below with reference to the following figures, wherein.

DETAILED DESCRIPTION

An exemplary embodiment of the present invention will be described.

(Configuration)

Figure 1:
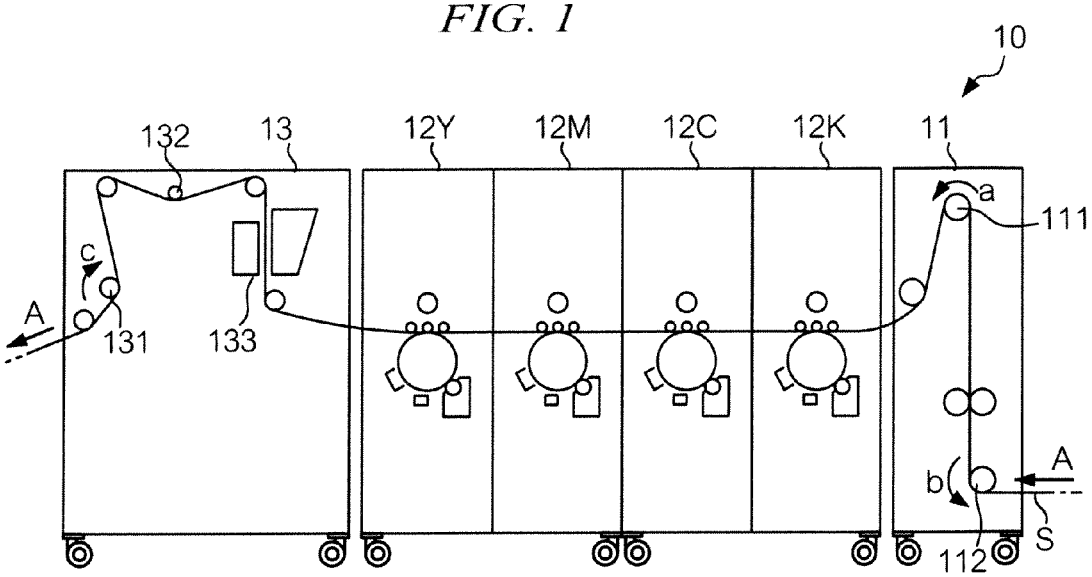
FIG. 1 is a diagram illustrating a configuration of an image-forming device according to an exemplary embodiment of the present invention.

FIG. 1 is a diagram illustrating a configuration of image-forming device 10 according to the present exemplary embodiment.

Image-forming device 10 includes feeding unit 11 that feeds a sheet extending in the longitudinal direction (hereinafter referred to as "continuous form paper S") from a sheet source (not shown) into image-forming device 10, image-forming units 12Y, 12M, 12C, and 12K that form a toner image on continuous form paper S, and fixing unit 13 that fixes the toner image on continuous form paper S. The three units are connected in series. Each unit has plural rollers inside it, which are examples of a transport unit that transports continuous form paper S in the direction of arrow A shown in FIG. 1. The plural rollers and guide members (not shown) form a sheet path of continuous form paper S. The sheet path of continuous form paper S is shown by the line indicated by "S" in FIG. 1.

Feeding unit 11 includes drive roller 111, back tension roller 112, a motor (not shown), which is a rotary drive source of the rollers 111 and 112, and plural rollers that are rotated by continuous form paper S being transported. Drive roller 111 is a member that rotates in the direction of arrow a shown in FIG. 1, thereby transporting continuous form paper S fed from a sheet source to image-forming units 12Y, 12M, 12C, and 12K. Back tension roller 112 is a member provided upstream relative to drive roller 111 in a transport direction of continuous form paper S, which rotates in the direction of arrow b shown in FIG. 1, thereby applying a force opposite to the transport direction of continuous form paper S, to continuous form paper S. The applied force maintains a proper degree of tension of continuous form paper S; as a result, continuous form paper S is transported along a sheet path so that the paper does not sag. It is to be noted that in the present exemplary embodiment, drive roller 111 is an example of a first roller, and back tension roller 112 is an example of a second roller. It is also to be noted that in the present exemplary embodiment, the first roller, the second roller, and a third roller (described later) are each an example of a transport unit and a tension applying unit.

Figure 2:
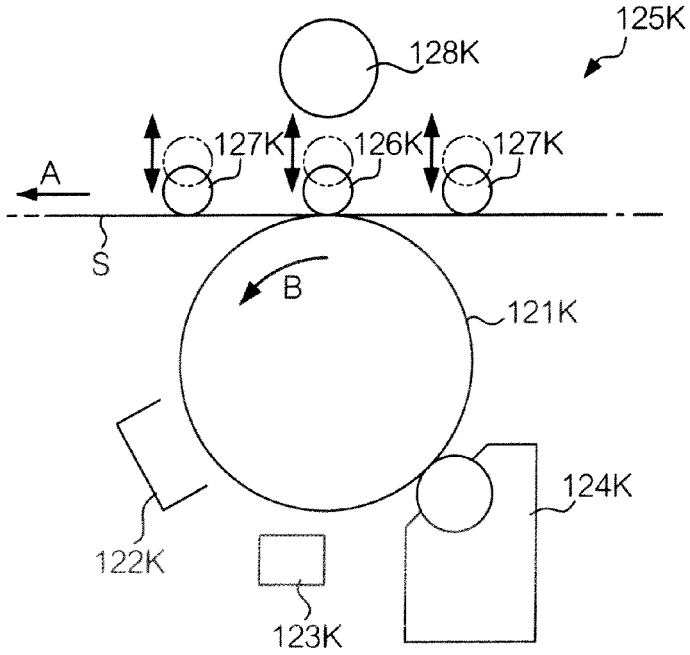
FIG. 2 is a diagram illustrating a configuration of an image-forming unit of the image-forming device.

Image-forming units 12Y, 12M, 12C, and 12K are units for forming an image using toner of yellow (Y), magenta (M), cyan (C), or black (K). The configurations of image-forming units 12Y, 12M, 12C, and 12K are the same, except that the color of toner is different in each unit. Accordingly, the configuration of only image-forming unit K, which is shown in FIG. 2, will be described. As shown in FIG. 2, image-forming unit K includes photoreceptor drum 121K, charging unit 122K, exposing unit 123K, developing unit 124K, and transfer unit 125K. Photoreceptor drum 121K is provided under a sheet path of continuous form paper S in the direction of gravitational force (in a downward direction of FIG. 2) so that the drum is rotatable in the direction of arrow B. Photoreceptor drum 121K is an example of an image carrier. Charging unit 122K charges the surface of photoreceptor drum 121K evenly. Exposing unit 123K irradiates light to photoreceptor drum 121K according to image data of color K (black), thereby forming an electrostatic latent image. Developing unit 124K develops an electrostatic latent image using toner of black, thereby forming a toner image on the surface of photoreceptor drum 121K. Transfer unit 125K transfers a toner image to continuous form paper S.

Transfer unit 125K includes transfer roller 126K, two transfer guide rollers 127K, sheet separation motor 128K, and a motor (not shown) that causes the rollers 126K and 127K, which are an example of a transfer unit, to rotate. If a transfer bias is applied between transfer roller 126K and photoreceptor drum 121K while continuous form paper S is held between the two units, a toner image is transferred from photoreceptor drum 121K to continuous form paper S. Transfer guide roller 127K is a unit for guiding continuous form paper S so that continuous form paper S is properly transported to between transfer roller 126K and photoreceptor drum 121K. Transfer guide roller 127K is provided upstream or downstream in a transport direction of continuous form paper S relative to transfer roller 126K (in FIGS. 1 and 2, transport guide roller 127K is provided both upstream and downstream). Transfer roller 126K is configured to move between a first position close to photoreceptor drum 121K (the position indicated by a solid line in FIG. 2) and a second position distant from photoreceptor drum 121K relative to the first position (the position indicated by a dashed line in FIG. 2). Transfer guide roller 127K is configured to move between a first position close to a sheet path of continuous form paper S (the position indicated by a solid line in FIG. 2) and a second position distant from the sheet path relative to the first position (the position indicated by a dashed line in FIG. 2). Sheet separation motor 128K is a unit for causing transfer roller 126K and transfer guide roller 127K to move between the first position and the second position. The rotational axes of sheet separation motor 128K, transfer roller 126K, and transfer guide rollers 127K are coupled via a driving force transmission mechanism (not shown) that includes gears, pulleys, and belts.

It is to be noted that in the following description, the components of image-forming unit 12Y, 12M, 12C, and 12K are referred to as "photoreceptor drum 121", "charging unit 122", "exposing unit 123", "developing unit 124", or "transfer unit 125", without attaching a symbol "Y", "M", "C", or "K".

Returning to FIG. 1, fixing unit 13 includes sub-drive roller 131, tension measuring roller 132, a motor (not shown) for causing sub-drive roller 131 to rotate, plural rollers that are rotated by continuous form paper S being transported, and fixing section 133 that fixes a toner image on continuous form paper S. Sub-drive roller 131 is a unit that rotates in the direction of arrow C shown in FIG. 1, thereby transporting continuous form paper S out of image-forming device 10. Tension measuring roller 132 measures tension applied to continuous form paper S. It is to be noted that in the present exemplary embodiment, sub-drive roller 131 is an example of a third roller.

Figure 3:
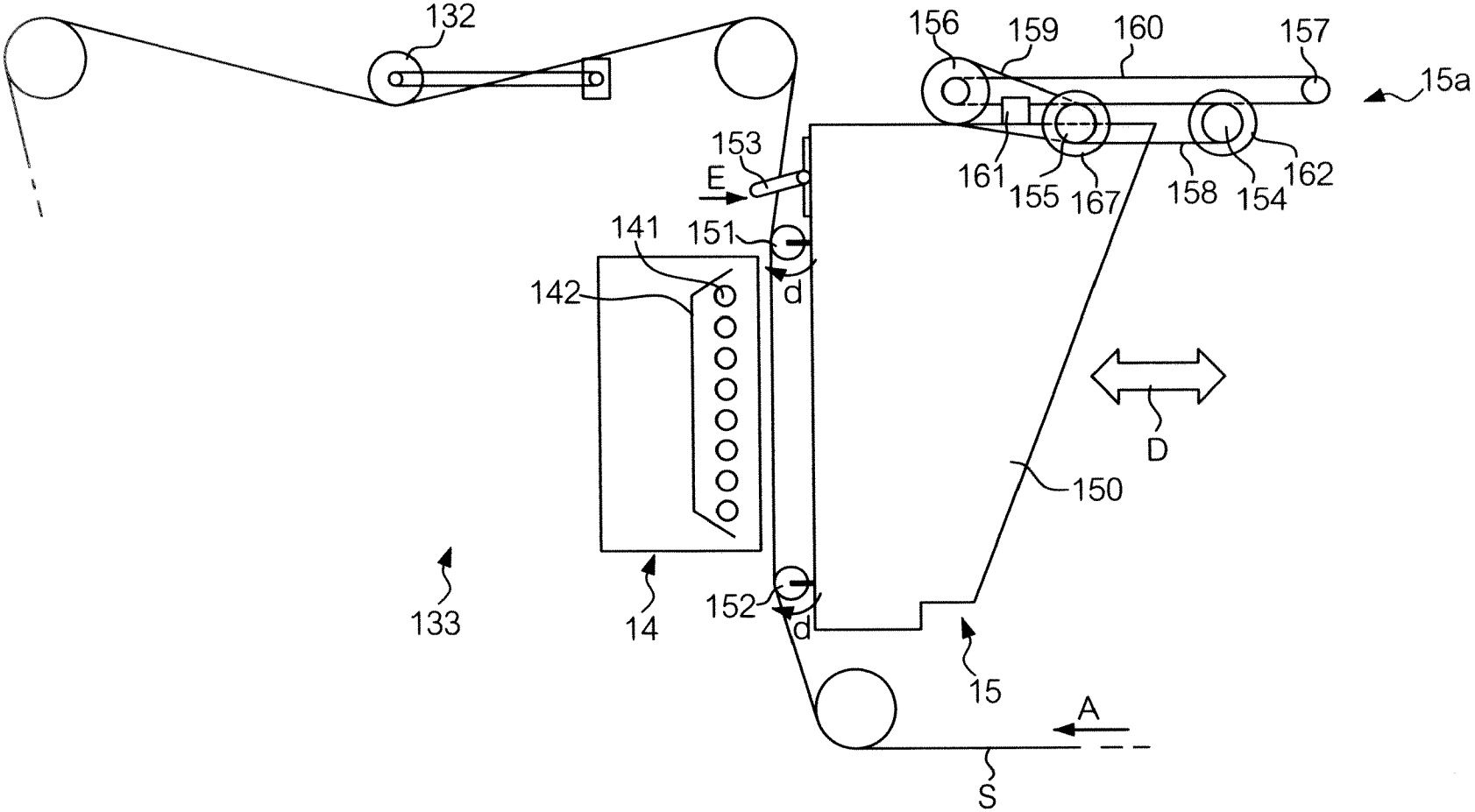
FIG. 3 is a diagram illustrating a configuration of a fixing unit of the image-forming device.

FIG. 3 is a diagram illustrating a configuration around fixing section 133 and tension measuring roller 132.

Fixing section 133 includes fuser 14 and fuser-facing unit 15, which are provided so that each of the units faces the other unit across a sheet path of continuous form paper S. Fuser 14 is provided at one side of a toner image, and fuser-facing unit 15 is provided at the other side. Fuser 14 is an example of a fixing unit, and fuser-facing unit 15 is an example of a retreat unit Fuser 14 includes plural flash lamps 141 which emit a flash of light at predetermined intervals and reflector plate 142 which opens at the front side of flash lamps 141 (the side near continuous form paper S) and closes at the back side of flash lamps 141 (the side far from continuous form paper S). Flash lamps 141 are arranged at predetermined intervals along a sheet path so that the long side of each flash lamp is parallel to the width direction of continuous form paper S (the direction perpendicular to transport direction A). Reflector plate 142 reflects a flash of light and heat emitted from flash lamp 141 to continuous form paper S.

Fuser-facing unit 15 includes base 150, fixing guide rollers 151 and 152 provided at base 150, guide member 153 provided at base 150, and movement mechanism 15*a*. Fixing guide roller 151 is provided at the downstream side of transport direction A, and fixing guide roller 152 is provided at the upstream side of transport direction A. Guide member 153 is provided further downstream than fixing guide roller 151. Movement mechanism 15*a* moves base 150 toward or away from fuser 14, as shown by arrow D of FIG. 3. Guide member 153 causes continuous form paper S to move away from fuser 14 as base 150 moves away from fuser 14. As such, fuser-facing unit 15 causes continuous form paper S to pass through a fixing position at which a toner image is fixed on continuous form paper S or a retract position which is located away from fuser 14 than the fixing position, and at which continuous form paper S is less affected by heat emitted from fuser 14 than at the fixing position. Fixing guide rollers 151 and 152 are caused to rotate in the direction of arrow d shown in FIG. 3 by a motor (not shown), and continuous form paper S is transported by the rotation of fixing guide rollers 151 and 152. Continuous form paper S is caused to maintain contact with fixing guide rollers 151 and 152 by its tension.

Figure 4:
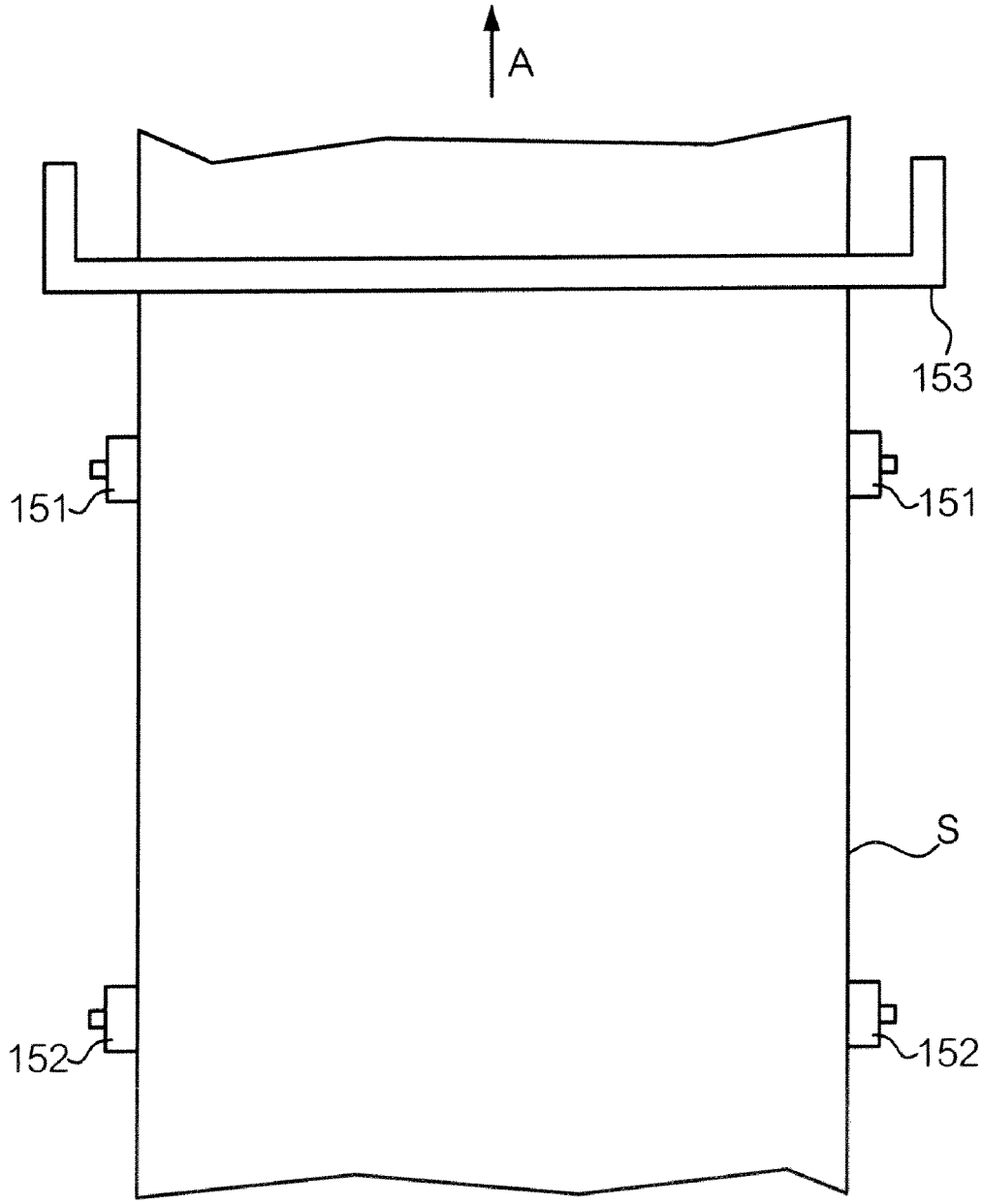
FIG. 4 is a diagram illustrating a configuration of a tension-measuring roller of the image-forming device.

FIG. 4 is a diagram illustrating fuser-facing unit 15 as seen from the position of fuser 14. Guide member 153 is U-shaped, and fixed to base 150. Guide member 153 is configured so that when a sheet is at a fixing position, the member does not make contact with continuous form paper S.

Figure 5:
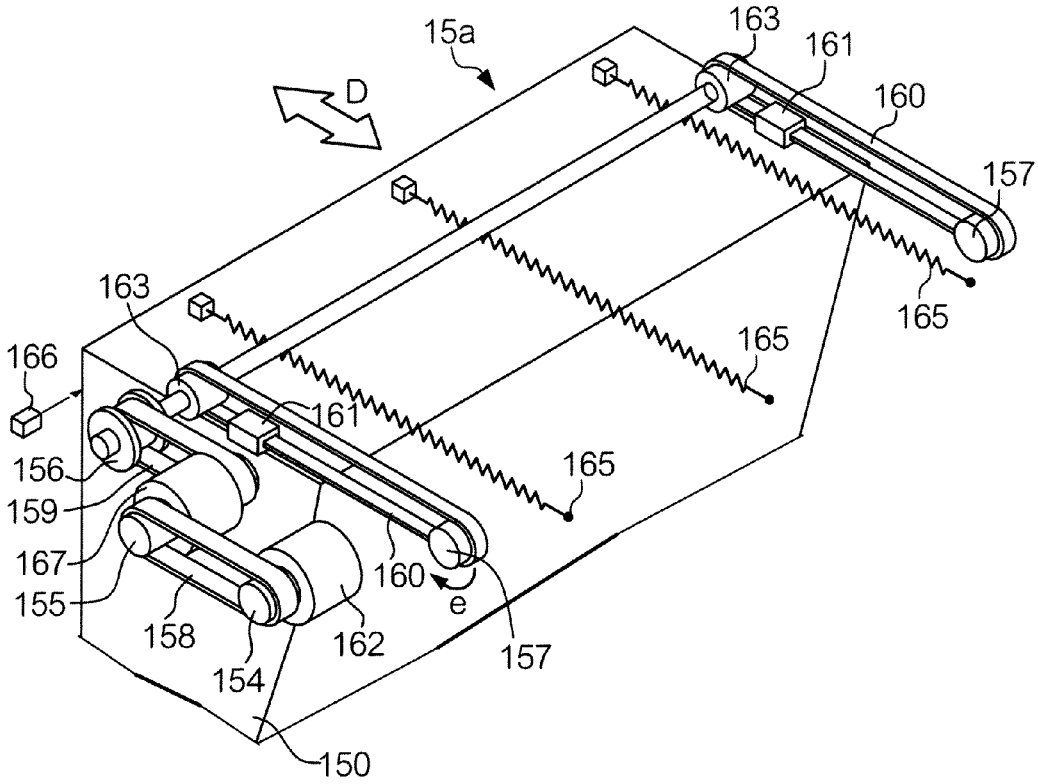
FIG. 5 is a diagram illustrating a configuration of a fuser-facing unit of the image-forming device.

FIG. 5 is a top perspective view illustrating fuser-facing unit 15. Movement mechanism 15*a* will be described in detail with reference to the drawing. Movement mechanism 15*a* includes motor 162, clutch 167, three springs 165, sensor 166, pulleys (first pulley 154, second pulley 155, third pulley 156, fourth pulleys 163, and fifth pulleys 157), belts (first belt 158 hung on first pulley 154 and second pulley 155, second belt 159 hung on a pulley behind clutch 167 in FIG. 5 and third pulley 156, and third belts 160 hung on fourth pulleys 163 and fifth pulleys 157). Motor 162 and clutch 167 are fixed to the housing of image-forming device 10. Third pulley 156 and fourth pulleys 163 are fixed to shaft 164, which is attached to the case of image-forming device 10 so that the shaft is able to rotate. Fifth pulleys 157 are attached to the housing of image-forming device 10 so that the pulleys are able to rotate. A part of third belts 160 is fixed to the upper surface of base 150 by fixture 161. One end of three springs 165 is fixed to the upper surface of base 150, and the other end is fixed to the housing of image-forming device 10. Three springs 165 pull base 150 away from fuser 14.

Clutch 167 is an electromagnetic clutch that transmits rotary torque to a pulley fixed to a rotating shaft only when the clutch is excited. First pulley 154 is fixed to the rotating shaft of motor 162. Rotation of motor 162 is, when clutch 167 is in an on state, transmitted to third belts 160 via first pulley 154, first belt 158, second pulley 155, clutch 167, second belt 159, third pulley 156, and fourth pulleys 163. When rotation is transmitted to third belts 160, third belts 160 rotate in the direction of arrow e shown in FIG. 5; as a result, base 150 to which third belts 160 are fixed and continuous form paper S are caused to move closer to fuser 14. If base 150 is detected by sensor 166, rotation of motor 162 is suspended; as a result, movement of base 150 and continuous form paper S are stopped. If clutch 167 is switched from an on state to an off state, clutch 167 will be in a free state; as a result, base 150 and continuous form paper S are caused to move away from fuser 14 by three springs 165 until base 150 hits a stopper (not shown).

Figure 6:
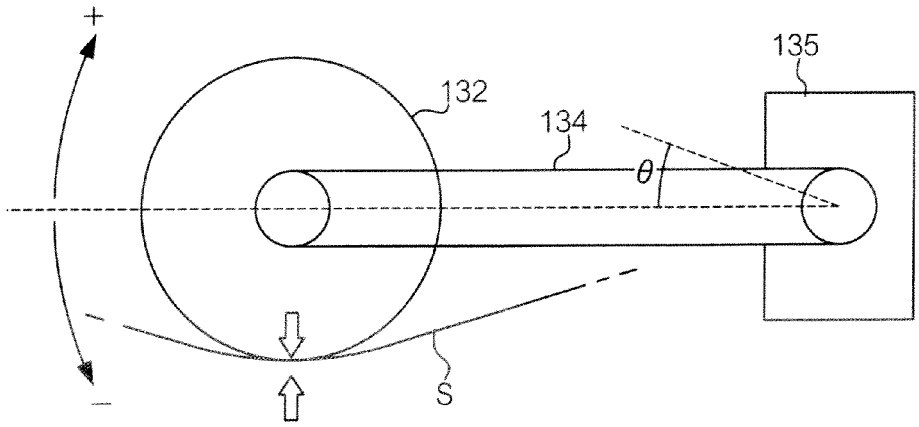
FIG. 6 is a perspective view illustrating a movement mechanism of the fuser-facing unit of the image-forming device.

FIG. 6 is a diagram illustrating a configuration around tension measuring roller 132.

Tension measuring roller 132 is attached to an end of arm 134 so that the roller is able to rotate. Tension measuring roller 132 is pushed by arm 134 toward continuous form paper S (in a downward direction in FIG. 6) at a constant pressure. Tension measuring roller 132 is also pushed upward by continuous form paper S, since continuous form paper S is tensioned. The downward pressure and the upward pressure oppose each other, and a vertical position of tension measuring roller 132 is determined on the basis of the balance of the two pressures. The other end of arm 134 is connected to angle sensor 135, which is fixed to the housing of image-forming device 10. Angle sensor 135 measures an angle between a direction in which arm 134 extends and the horizontal direction. The side above the horizon is a plus side, and the side below the horizon is a minus side. Since the downward pressure applied to tension measuring roller 132 and continuous form paper S by arm 134 is constant, an angle measured by angle sensor 135 indicates the degree of tension applied to continuous form paper S.

Figure 7:
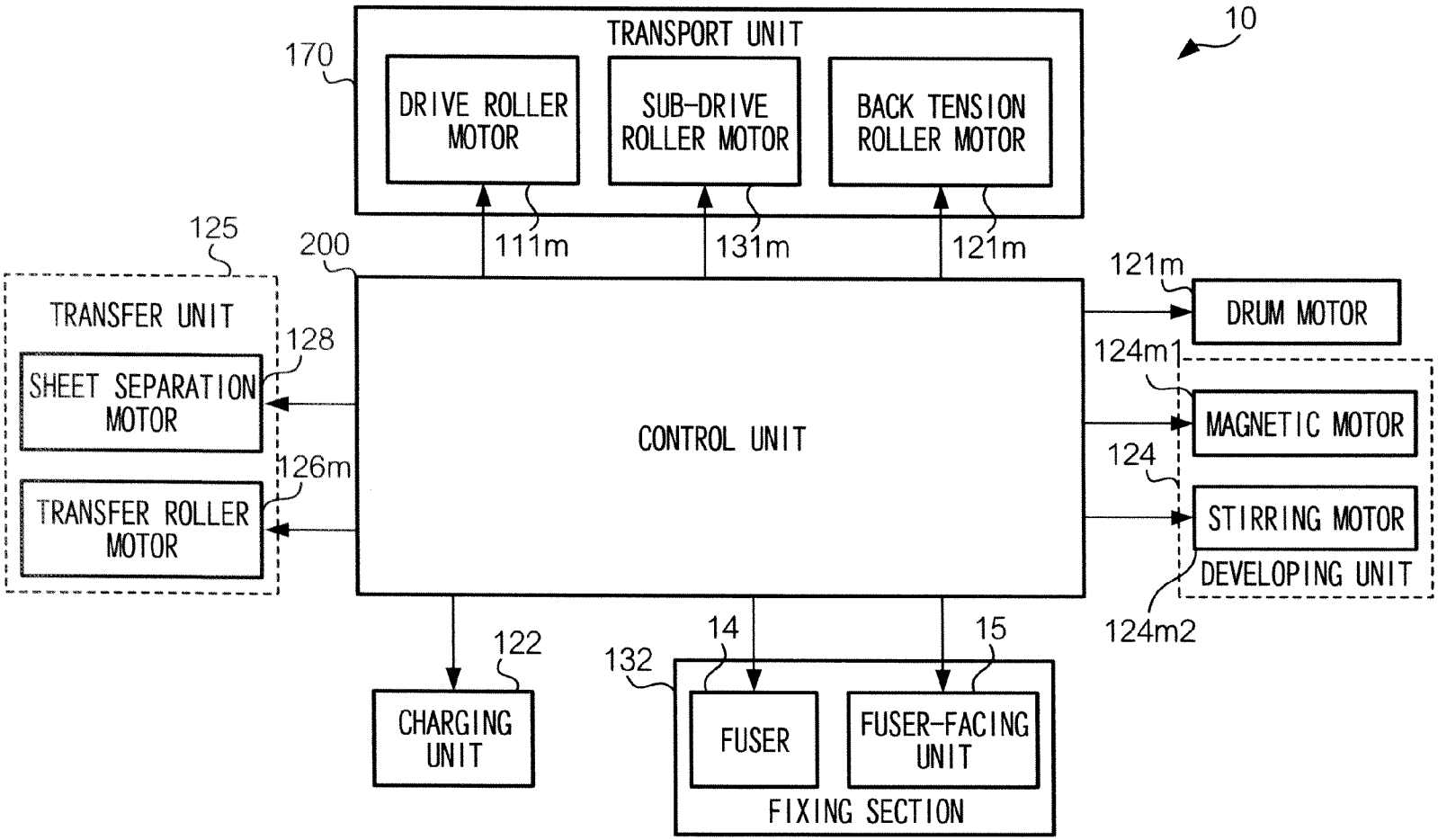
FIG. 7 is a diagram illustrating a configuration of a control system of the image-forming device.

FIG. 7 is a block diagram illustrating a configuration of a control system of image-forming device 10.

Control unit 200 includes a CPU (Central Processing Unit), a ROM (Read Only Memory) and a RAM (Random Access Memory), which is housed in feeding unit 11, image-forming unit 12Y, 12M, 12C, or 12K, or fixing unit 13. The CPU retrieves a control program stored in the ROM, loads the program in the RAM, and executes the instructions for the program, thereby controlling components of image-forming device 10 such as drum motor 121*m*, charging unit 122, developing unit 124, transfer unit 125, fixing unit 133, or transport unit 170. Drum motor 121*m* is a driving unit for causing photoreceptor drum to rotate. Developing unit 124 includes magnetic motor 124*m*1 which is a driving unit for causing a magnetic roll provided in a developer storage of developing unit 124 to rotate and stirring motor 124*m*2 which is a driving unit for causing a stirring roll provided in a developer storage to rotate. Transfer unit 125 includes, in addition to sheet separation motor 128 described above, transfer roller motor 126*m* which is a driving unit for causing transfer roller 126 to rotate. Fixing unit 133 includes fuser 14 and fuser-facing unit 15, as described above. Transport unit 170 includes drive roller motor 111*m* which is a driving unit for causing drive roller 111 to rotate, back tension roller motor 112*m* which is a driving unit for causing back tension roller 112 to rotate, and sub-drive roller motor 131*m* which is a driving unit for causing sub-drive roller 131 to rotate.

(Operation)

Now, an operation of image-forming device 10 will be described with reference to a timing chart shown in FIG. 8. Specifically, a retreat operation of control unit 200 to distance continuous form paper S from fuser 14 after an image-forming operation is made will be described.

After an image-forming operation to continuous form paper S such as a transfer operation and a fixing operation is made, control unit 200, while transporting continuous form paper S, switches sheet separation motor 128 from a contact state to a first separation state at time t1. When the switching is performed, transfer roller 126 is caused to move from a first position (the position indicated by a solid line of FIG. 2) to a second position (the position indicated by a dashed line of FIG. 2) so that the surface of transfer roller 126 is detached from continuous form paper S. Subsequently, at time t2, control unit 200 switches transfer roller motor 126*m* from an on state to an off state, thereby suspending rotation of transfer roller 126.

Subsequently, at time t3, control unit 200 switches sheet separation motor 128 from a first separation state to a second separation state, and changes a charging bias of charging unit 122 from an on state to an off state, thereby suspending charging against photoreceptor drum 121. As a result, transfer guide rollers 127 move from a first position (the position indicated by a solid line in FIG. 2) to a second position (the position indicated by a dashed line in FIG. 2). When transfer guide rollers 127 move to the second position, since constant tension is being applied to continuous form paper S, the paper moves further upward than during a transfer process; as a result, the under face of the paper is separated from photoreceptor drum 121. Since transfer roller 126 which holds continuous from paper S between the roller and photoreceptor drum 121 is caused to move to the second position before transfer guide rollers 127, contact between continuous form paper S and photoreceptor drum 121 is reduced, and accordingly a degree of contamination on continuous form paper S is reduced, as compared with a case in which transfer roller 126 remains at the first position.

Subsequently, at time t4, control unit 200 changes a developing bias of drum motor 121*m*, magnetic motor 124*m*1, stirring motor 124*m*2, and developing unit 124 from an on state to an off state. As a result, rotation of each of photoreceptor drum 121, a magnetic roll, and a stirring roll is suspended, and a developing bias against photoreceptor drum 121 becomes zero. Subsequently, at time t5, control unit 200 switches fuser 14 from an on state to an off state. As a result, power supply to flash lamps 141 is suspended; consequently, emission of a flash of light is suspended.

Subsequently, at tire 6, which is after drum motor 121*m* is switched to an off state, and rotation of photoreceptor drum 121 is suspended, control unit 200 switches back tension roller motor 113*m*, drive roller motor 111*m*, and sub-drive roller motor 131*m* from an on state to an off state. After the switching is performed, rotation of each of back tension roller 112, drive roller 111, and sub-drive roller 131 gradually slows down. Subsequently, at time 7 immediately subsequent to time 6, control unit 200 switches a RUN mode of sub-drive roller motor 131*m* from an on state to an off state, and switches clutch 167 from an on state to an off state. The "RUN mode" is a control mode for switching on and off a servo operation of sub-drive roller motor 131*m*. If a RUN mode is switched from an on state to an off state, rotation of sub-drive roller 131 rapidly slows down and stops in accordance with a servo control.

Figure 8:
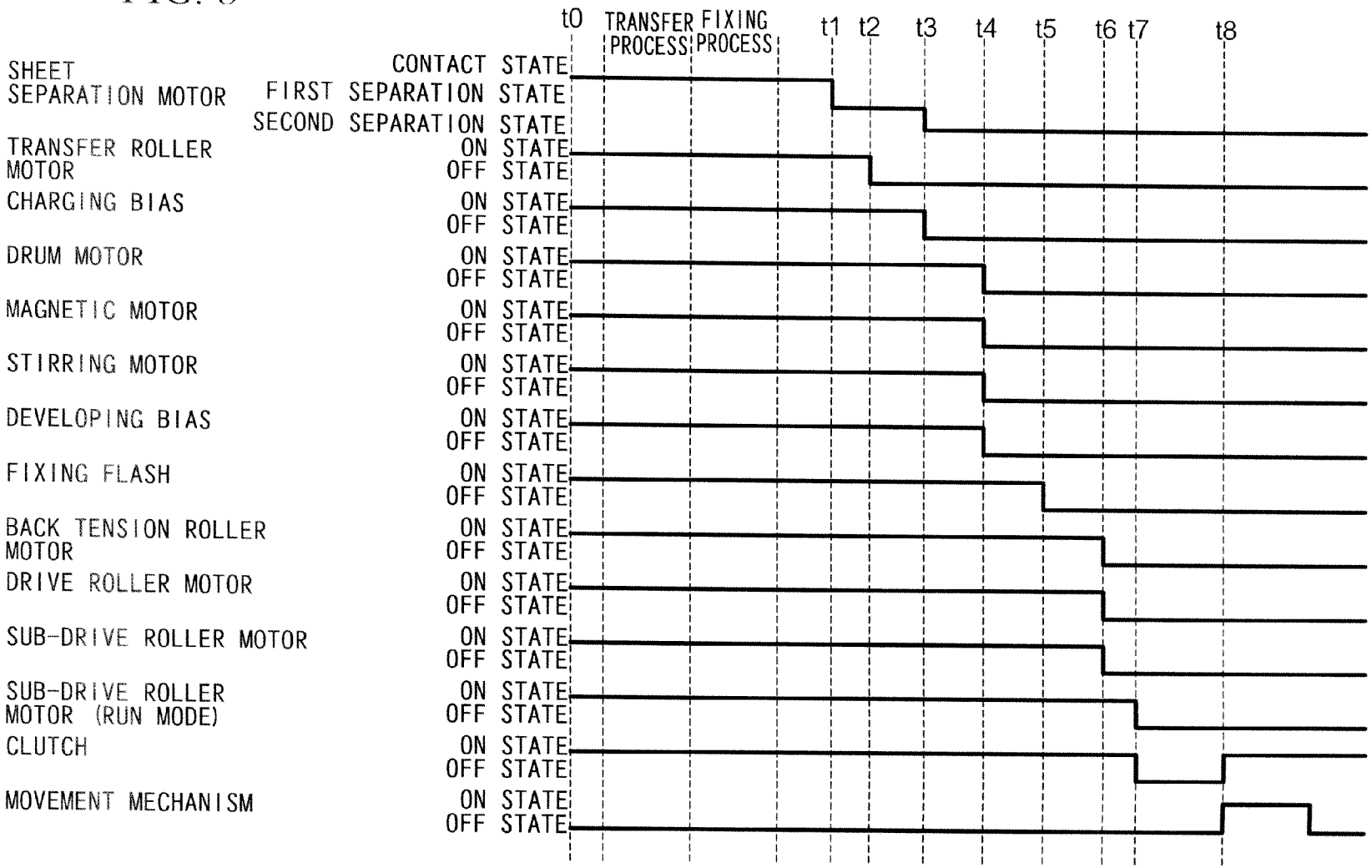
FIG. 8 is a timing chart illustrating an operation of the image-forming device.
Figure 9:
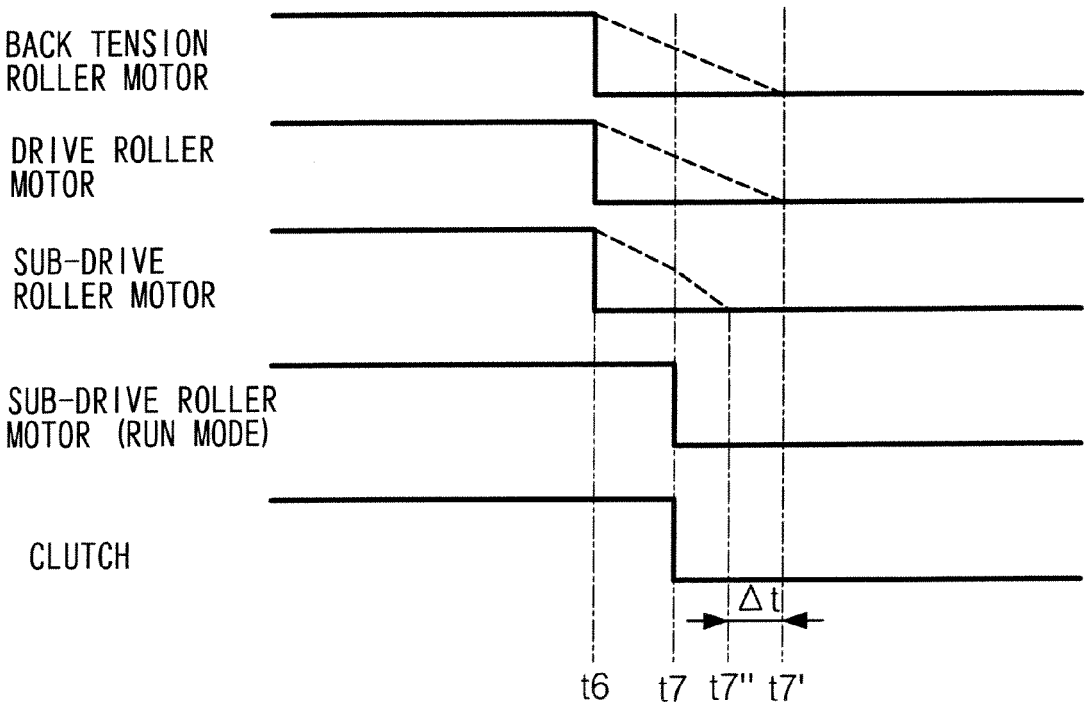
FIG. 9 is a timing chart illustrating an operation of the image-forming device.

FIG. 9 is a diagram illustrating detailed operations from time t6 to t7 shown in FIG. 8.

At time t6, control unit 200 switches back tension roller motor 113*m*, drive roller motor 111*m*, and sub-drive roller motor 131*m* from an on state to an off state; as a result, rotation of back tension roller 112 and drive roller 111 gradually slows down, as indicated by the dashed lines in FIG. 9, and completely stops at time t7'. Control unit 200 switches a RUN mode of sub-drive roller motor 131*m* from an on state to an off state at time t7; as a result, rotation of only sub-drive roller 131 rapidly slows down relative to that of back tension roller 112 and drive roller 131, and completely stops at time t7". The rotation of sub-drive roller 131 stops earlier than that of back tension roller 112 and drive roller 111 by time Δt.

Since sub-drive roller 131, which is a transport unit provided downstream in the transport direction, stops transporting continuous form paper S earlier than drive roller 111 (which is a transport unit provided upstream in the transport direction) does, tension of continuous form paper S decreases and accordingly continuous form paper S sags downward by the action of gravity. As a result, if continuous form paper S comes into contact with photoreceptor drum 121 located under the paper in the direction of gravitational force, since rotation of photoreceptor drum 121 is already stopped, the amount of residual toner attached to continuous form paper S, from the surface of photoreceptor drum 121 is less than when photoreceptor drum 121 is rotating.

Figure 11:
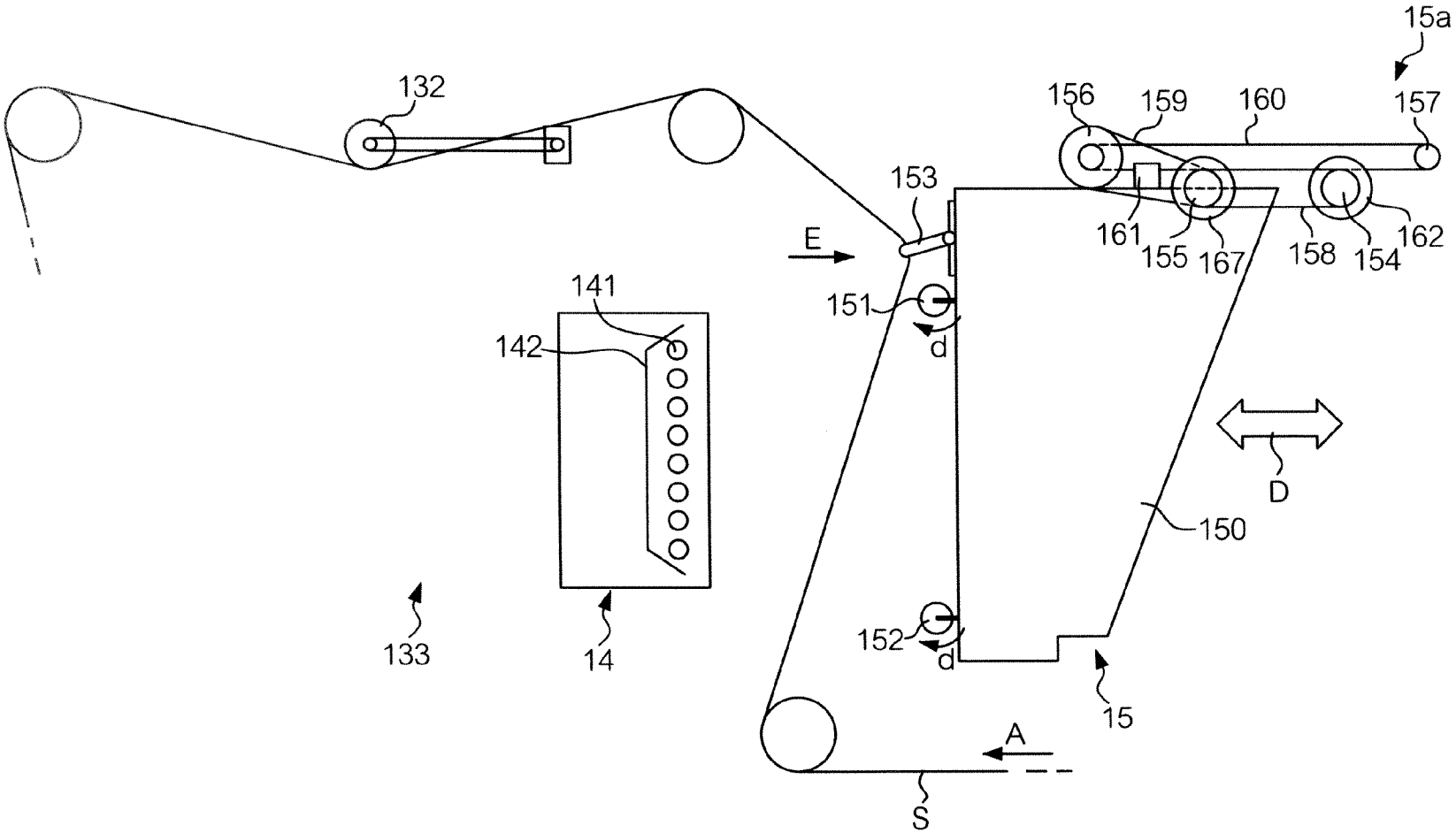
FIG. 11 is a diagram illustrating a configuration of a fixing unit of the image-forming device.

At time t7, clutch 165 is switched to an off state whereby a transmission function of clutch 165 is disabled. As a result, base 150 is allowed to move freely, and is pulled by elastic force of springs 165, together with continuous form paper S guided by guide member 153, away from fuser 14. As a result, fuser 14, fuser-facing unit 15, and continuous form paper S are moved from the positions shown in FIG. 3 to the positions shown in FIG. 11. When continuous form paper S is distanced from fuser 14, since continuous form paper S is relaxed, damage to continuous form paper S is less than when continuous form paper S is distanced from fuser 14 while continuous form paper S is tensioned.

Returning to FIG. 8, when a time sufficient for fuser 14 to cool down elapses from time t5 (in FIG. 8, at time t8), control unit 200 switches clutch 165 from an off state to an on state, and switches motor 162 of movement mechanism 15*a* from an off state to an on state, to start an operation of reducing a degree of slackness of continuous form paper S in preparation for a subsequent image-forming operation. As a result, base 150 is caused to move closer to fuser 14 against elastic force of springs 165. Subsequently, control unit 200 starts a slack reduction operation shown in FIG. 10.

Control unit 200 sets variable N to zero (step S1). Subsequently, after confirming that variable N is smaller than four (step S2; YES), control unit 200 determines whether an angle measured by angle sensor 135 of tension measuring roller 132 is equal to or more than 1.5 degrees (step S3). If the measured angle is equal to or more than 1.5 degrees (step S3; YES), which means that tension being applied to continuous form paper S is excessive, control unit 200 switches back tension roller motor 113*m* and drive roller motor 111*m* to an on state (step S4). As a result, only the upstream side of continuous form paper S is transported, so that tension applied to continuous form paper S is reduced, and an angle measured by angle sensor 135 becomes closer to zero. Subsequently, control unit 200 determines that an angle measured by angle sensor 135 is within plus or minus 0.75 degrees (step S5). If the measured angle is within plus or minus 0.75 degrees (step S5; YES), which means that a degree of slackness of continuous form paper S is within a predetermined range, control unit 200 switches back tension roller motor 113*m* and drive roller motor 111*m* to an off state (step S6). Control unit 200 repeats the above operations until variable N is equal to four.

At step S3, if the angle measured by angle sensor 135 is less than 1.5 degrees (step S3; NO), control unit 200 determines whether the measured angle is less than or equal to minus 1.5 degrees (step S8). If the measured angle is less than or equal to minus 1.5 degrees (step S8; YES), which means that tension being applied to continuous form paper S is insufficient, control unit 200 switches sub-drive roller motor 131*m* to an on state (step S9). As a result, only the downstream side of continuous form paper S is transported, so that tension applied to continuous form paper S is increased, and an angle measured by angle sensor 135 becomes closer to zero. Subsequently, control unit 200 determines whether an angle measured by angle sensor 135 is within plus or minus 0.75 degrees (step S10), and if the determination is affirmative (step S10; YES), control unit 200 switches sub-drive roller motor 131*m* to an off state (step S11). Subsequently, control unit 200 increments variable N by one (step S12), and repeats the above operations until variable N is equal to four.

If variable N becomes equal to four (step S2; NO), control unit 200 terminates the slack reduction operation. If at step S5 or step S10, an angle measured by angle sensor 135 is not within plus or minus 0.75 degrees, control unit 200 outputs an error message and thereafter terminates the slack reduction operation (steps S13 and S14).

(Modifications)

The above exemplary embodiment may be modified as described below.

In the above exemplary embodiment, a recording medium may be, instead of paper, a plastic sheet such as an OHP sheet or a cut of cloth, if the recording medium extends in a longitudinal direction.

In the above exemplary embodiment, the position of fixing section 133 may be changed as long as the location is in the downstream side of photoreceptor drum 121 in the transport direction of continuous form paper S.

In the above exemplary embodiment, where rotation of photoreceptor drum 121 is stopped after the whole image-forming operation including a transfer operation and a fixing operation is completed, rotation of photoreceptor drum 121 may be stopped immediately after a transfer operation is completed, because photoreceptor drum 121 completes its role with an end of the transfer operation.

In the above exemplary embodiment, control unit 200, after an image is transferred from photoreceptor drum 121 to continuous form paper S, firstly causes transfer roller 126 to move to the second position, secondly suspends rotation of photoreceptor drum 121, thirdly suspends transportation of continuous form paper S, and fourthly distances continuous form paper S from fuser 14, to reduce contact between continuous form paper S and photoreceptor drum 121, thereby to reduce a degree of contamination on continuous form paper S. However, in the process, control unit 200 may distance continuous form paper S from fuser 14 before suspending transportation of continuous form paper S by transport unit 170. Alternatively, control unit 200 may simultaneously carry out the two operations. To decrease contacts between continuous form paper S and photoreceptor drum 121, thereby to reduce a degree of contamination on continuous form paper S, control unit 200 has merely to suspend rotation of photoreceptor drum 121 after an image is transferred from photoreceptor drum 121 to continuous form paper S, and to stop transportation of continuous form paper S by transport unit 170 and distance continuous form paper S from fuser 14 after the rotation of photoreceptor drum 121 is suspended.

In the above exemplary embodiment, fixing section 133 stops emission of a flash of light before transportation of continuous form paper S is suspended, to reduce the effect of a flash of light to continuous form paper S. However, if the effect of a flash of light is negligible, the emission of a flash of light may be stopped at the same time as the suspension of transportation of continuous form paper S. Alternatively, the emission of a flash of light may be stopped after transportation of continuous form paper S is suspended.

In the above exemplary embodiment, transfer roller 126 is caused to move to the second position before rotation of photoreceptor drum 121 is suspended, to distance continuous form paper S from photoreceptor drum 121. However, transfer roller 126 may be caused to move to the second position at the same time as the suspension of rotation of photoreceptor drum 121. Alternatively, after transfer roller 126 is caused to move to the second position, rotation of photoreceptor drum 121 may be suspended.

In the above exemplary embodiment, where transfer guide rollers 127 are caused to move to the second position after transfer roller 126 is caused to move to the second position transfer guide rollers 127 and transfer roller 126 may be simultaneously caused to move to the second position.

In the above exemplary embodiment, while transportation of continuous form paper S by transport unit 170 is suspended, continuous form paper S is caused to sag over fuser 14, and to move away from fuser 14. However, continuous form paper S may be caused to sag over a sheet path after transportation of continuous form paper S by transport unit 170 is stopped, and thereafter to move away from fuser 14.

In the above exemplary embodiment, where tension is applied to continuous form paper S by drive roller 111, sub-drive roller 131, and back tension roller 112, tension may be applied by a configuration that pushes continuous form paper S in a direction perpendicular to a surface of the paper.

Figure 10:
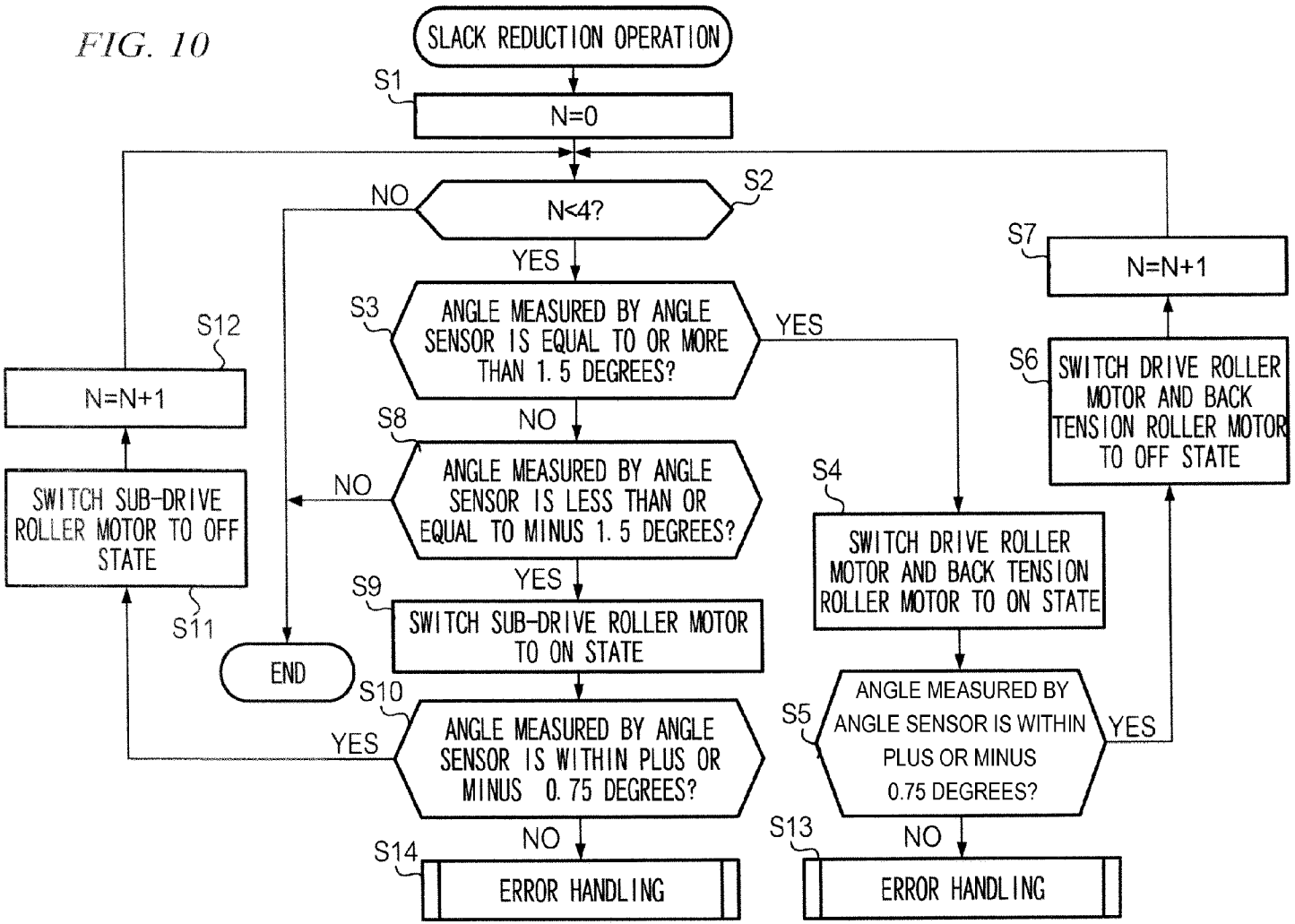
FIG. 10 is a flowchart illustrating an operation of the image-forming device.

In the above exemplary embodiment, if it is determined that tension being applied to continuous form paper S is excessive at step S3 of FIG. 10, control unit 200 switches back tension roller motor 113*m* and drive roller motor 111*m* to an on state at step S4. However, control unit 200 may control sub-drive roller motor 131*m* to cause sub-drive roller 131 to rotate in a direction opposite to the transport direction, to reduce tension applied to continuous form paper S.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming device comprising:

a transport unit that transports a recording medium that extends in a longitudinal direction;

a tension applying unit that applies tension to the recording medium;

an image carrier that holds a toner image;

a transfer unit that holds the recording medium between the transfer unit and the image carrier, and that transfers the toner image held by the image carrier to the recording medium while tension is applied to the recording medium by the tension applying unit;

a fixing unit provided downstream in a transport direction of the recording medium relative to the image carrier, that fixes the toner image transferred to the recording medium on the recording medium;

a retreat unit that causes the recording medium to move away from the fixing unit; and a control unit programmed to execute a process, the process including:

controlling the tension applying unit to apply tension to a recording medium that extends in a longitudinal direction transported by the transporting unit;

controlling the transfer unit to transfer a toner image held by the image carrier to the recording medium, while the tension is applied to the recording medium by the tension applying unit;

controlling the image carrier to suspend rotation of the image carrier;

controlling the tension applying unit to suspend application of the tension to the recording medium after the rotation of the image carrier is suspended; and controlling the retreat unit to move away the recording medium from the fixing unit after the tension applied to the recording medium by the tension applying unit is decreased.

2. The image-forming device according to claim 1, wherein:

the transfer unit moves between a first position which opposes the image carrier and a second position which is located farther away from the image carrier than the first position; and when transportation of the recording medium by the transport unit is suspended, the transfer unit is caused to move to the second position before rotation of the image carrier is suspended, to distance the recording medium from a surface of the image carrier.

3. The image-forming device according to claim 1, wherein:

the tension applying unit includes:

a first roller provided upstream in the transport direction of the recording medium relative to the image carrier, that rotates to transport the recording medium;

a second roller provided upstream in the transport direction of the recording medium relative to the first roller, that rotates so that the second roller applies force in a direction opposite to the transport direction to the recording medium; and a third roller provided downstream in the transport direction of the recording medium relative to the fixing unit, that rotates to transport the recording medium, and the tension applying unit suspends application of tension to the recording medium by suspending, when the first roller, the second roller, and the third roller are in rotation, rotation of the third roller before rotation of the first roller and rotation of the second roller.

4. An image-forming device comprising:

a transport means for transporting a recording medium that extends in a longitudinal direction;

a tension applying means for applying tension to the recording medium;

an image carrying means for holding a toner image;

a transfer means for holding the recording medium between the transfer means and the image carrying means, and for transferring the toner image held by the image carrying means to the recording medium while tension is applied to the recording medium by the tension applying means;

a fixing means provided downstream in a transport direction of the recording medium relative to the image carrying means, for fixing the toner image transferred to the recording medium on the recording medium;

a retreat means for causing the recording medium to move away from the fixing means; and a control means configured to execute a process, the process including:

controlling the tension applying means to apply tension to a recording medium that extends in a longitudinal direction transported by the transporting means;

controlling the transfer means to transfer a toner image held by the image carrying means to the recording medium, while the tension is applied to the recording medium by the tension applying means;

controlling the image carrying means to suspend rotation of the image carrying means;

controlling the tension applying means to suspend application of the tension to the recording medium after the rotation of the image carrying means is suspended; and controlling the retreat means to move away the recording medium from the fixing means after the tension applied to the recording medium by the tension applying means is decreased.

5. An image-forming method comprising:

transporting a recording medium that extends in a longitudinal direction;

applying tension to the recording medium;

transferring a toner image from an image carrier to the recording medium while the tension is applied to the recording medium;

fixing the toner image, which is transferred from the image carrier, on the recording medium with a fixing unit;

suspending rotation of the image carrier;

suspending application of the tension to the recording medium after the rotation of the image carrier is suspended; and moving away, with a retreat unit, the recording medium from the fixing unit after the tension applied to the recording medium is decreased.

* * * * *